US009352596B2

(12) United States Patent
Miyajima et al.

(10) Patent No.: US 9,352,596 B2
(45) Date of Patent: May 31, 2016

(54) LIQUID EJECTING APPARATUS WITH WIRING BOARD POSITIONED BETWEEN TRANSPORT ROLLERS

(71) Applicant: SEIKO EPSON CORPORATION, Tokyo (JP)

(72) Inventors: Hiroki Miyajima, Matsumoto (JP); Mitsuhiro Koseki, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/630,082

(22) Filed: Feb. 24, 2015

(65) Prior Publication Data

US 2015/0246537 A1 Sep. 3, 2015

(30) Foreign Application Priority Data

Feb. 28, 2014 (JP) ..... 2014-039408

(51) Int. Cl.
*B41J 23/00* (2006.01)
*B41J 29/02* (2006.01)
*B41J 11/00* (2006.01)

(52) U.S. Cl.
CPC ..... *B41J 29/023* (2013.01); *B41J 11/005* (2013.01)

(58) Field of Classification Search
None
See application file for complete search history.

(56) References Cited

U.S. PATENT DOCUMENTS

2012/0013683 A1* 1/2012 Suzuki ..... B41J 2/17513 347/50
2014/0198144 A1* 7/2014 Miyajima ..... B41J 2/175 347/6

FOREIGN PATENT DOCUMENTS

JP 2000-233546 8/2000
JP 2000233546 A * 8/2000

* cited by examiner

*Primary Examiner* — Bradley Thies
(74) *Attorney, Agent, or Firm* — Workman Nydegger

(57) ABSTRACT

A liquid ejecting apparatus includes a first transport roller, and a second transport roller which transports a medium; and a liquid ejecting head which includes a plurality of nozzle openings, and ejects liquid toward the medium which is transported, a pressure generation unit which causes a change in pressure in liquid in a flow path, and a wiring board of which one face is arranged so as to face a direction in which the liquid is ejected, and is electrically connected to the pressure generation unit, in which the wiring board is arranged between the first transport roller and the second transport roller, and is arranged at a position at which the wiring board does not overlap with the first transport roller and the second transport roller and the first transport roller or the second transport roller is arranged at a position at which the roller overlaps with the liquid ejecting head.

2 Claims, 11 Drawing Sheets

LIQUID EJECTING APPARATUS WITH WIRING BOARD POSITIONED BETWEEN TRANSPORT ROLLERS

The entire disclosure of Japanese Patent Application No: 2014-039408, filed Feb. 28, 2014 is expressly incorporated by reference herein in its entirety.

BACKGROUND

1. Technical Field

The present invention relates to a liquid ejecting apparatus including a liquid ejecting head which ejects liquid from a nozzle opening, and a first transport roller and a second transport roller which transport a medium for ejecting with respect to the liquid ejecting head.

2. Related Art

As the liquid ejecting apparatus, for example, there is an ink jet recording apparatus which includes an ink jet recording head which discharges liquid ink as ink droplets, and performs recording of an image, or the like, by forming a dot by causing ink droplets which are discharged from a nozzle of the ink jet recording head to land on the medium for ejecting such as a recording sheet.

In the ink jet recording apparatus, a first transport roller and a second transport roller are provided on the respective upstream side and downstream side, at which an ink jet recording head is interposed therebetween, in a transport direction of a medium for ejecting, and ink droplets which are ejected from the ink jet recording head are caused to land on the medium for ejecting which is transported and held between the first transport roller and the second transport roller (for example, JP-A-2000-233546).

SUMMARY

However, when a distance between a first transport roller and a second transport roller increases, an ink jet recording apparatus becomes large, and floating of a medium for ejecting occurs between the first transport roller and the second transport roller, and as a result, there is a problem in that it is difficult to control a posture of the medium for ejecting, and a landing position of ink droplets which are ejected from an ink jet recording head is shifted.

In addition, in order to provide the first transport roller and the second transport roller so as to be close to each other, the ink jet recording head should be arranged by being moved to a position at which the recording head is not interfered with by the first transport roller and the second transport roller, and there is a problem in that the ink jet recording apparatus becomes large in a liquid ejecting direction. In addition, when a distance between a liquid ejecting face on which ink droplets of the ink jet recording head are ejected and a medium for ejecting increases, there is a problem in that a shift in landing position of ink droplets occurs, and a printing speed slows down.

In addition, such a problem is not limited to the ink jet recording apparatus, and also exists in a liquid ejecting apparatus which ejects liquid other than ink.

An advantage of some aspects of the invention is to provide a liquid ejecting apparatus which can be miniaturized by suppressing a shift in landing position of liquid and slow down of printing speed, by making control of a posture of a medium for ejecting easy.

According to an aspect of the invention, there is provided a liquid ejecting apparatus which includes a first transport roller, and a second transport roller which transports a medium for ejecting between the first transport roller and the second transport roller; and a liquid ejecting head which includes a plurality of nozzle openings which are arranged between the first transport roller and the second transport roller, and ejects liquid toward the medium for ejecting which is transported, a pressure generation unit which causes a change in pressure in liquid in a flow path which communicates with the plurality of nozzle openings, and a wiring board of which one face is arranged so as to face a direction in which the liquid is ejected, and is electrically connected to the pressure generation unit, in which the wiring board is arranged between the first transport roller and the second transport roller, and is arranged at a position at which the wiring board does not overlap with the first transport roller and the second transport roller, and in which at least one of the first transport roller and the second transport roller is arranged at a position at which the roller overlaps with the liquid ejecting head.

According to the aspect, it is possible to secure a space for arranging a driven roller, or the like, which is related to at least one of the first transport roller and the second transport roller at a position at which the roller overlaps with the liquid ejecting head, without widening a gap between a liquid ejecting face and a medium for ejecting, and without making the liquid ejecting head and the liquid ejecting apparatus large in a liquid ejecting direction, by arranging at least one of the first transport roller and the second transport roller at a position at which the roller overlaps with the liquid ejecting head, and arranging the wiring board at a position not overlapping with the first transport roller and the second transport roller. In addition, since it is possible to make a distance between the first transport roller and the second transport roller short, it is possible to fix a posture of the medium for ejecting with high accuracy by suppressing floating, or the like, of the medium for ejecting which is held between the first transport roller and the second transport roller, and to make the liquid ejecting apparatus in a transport direction of the medium for ejecting small. In addition, it is possible to arrange the wiring board at a position which is close to the liquid ejection face, and to manufacture the apparatus to be small, and at low cost by making a wiring member which connects the wiring board and the pressure generation unit short.

In the liquid ejecting apparatus, the liquid ejecting head may include a head main body which ejects liquid, and a holding member which holds the head main body, and the wiring board may be accommodated inside the holding member. In this manner, it is possible to suppress a short circuit of wiring, or a failure of an electronic component by suppressing adhesion of liquid to the wiring board.

In the liquid ejecting apparatus, a connector which is connected to a flexible board may be provided on the wiring board, and the flexible board which is connected to the connecter may be derived in a direction intersecting the transport direction. In this manner, it is possible to make a width of the liquid ejecting head in the transport direction smaller by deriving the flexible board which is connected to the connector in the direction intersecting the transport direction.

In the liquid ejecting apparatus, at least one of the first transport roller and the second transport roller which is arranged at a position at which the roller overlaps with the liquid ejecting head may be arranged at a position overlapping with a flow path which is provided in the liquid ejecting head. In this manner, it is possible to form the flow path in a wide space.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the invention will be described in detail based on embodiments.

First Embodiment

Figure 1:
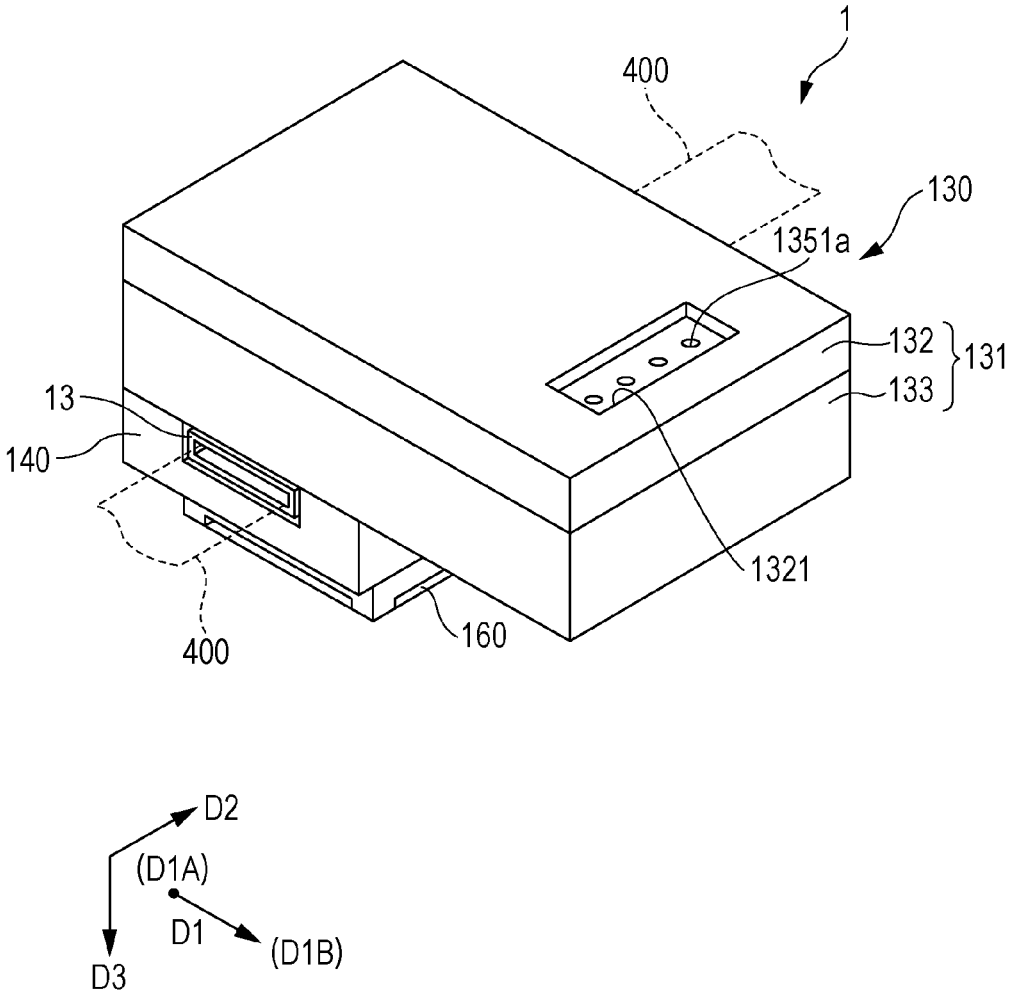
FIG. 1 is a perspective view of a recording head according to a first embodiment of the invention.
Figure 2:
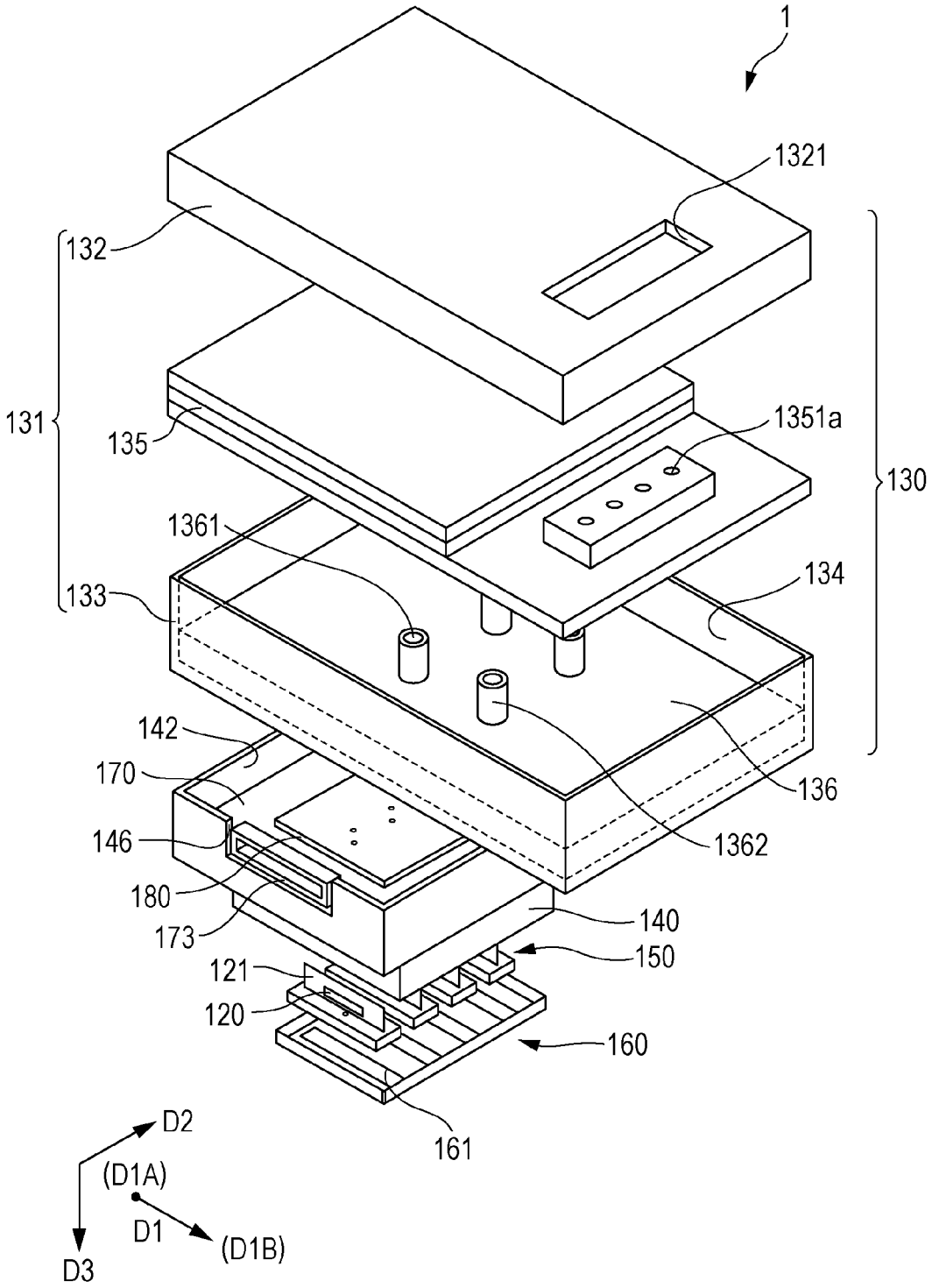
FIG. 2 is an exploded perspective view of the recording head according to the first embodiment of the invention.
Figure 3:
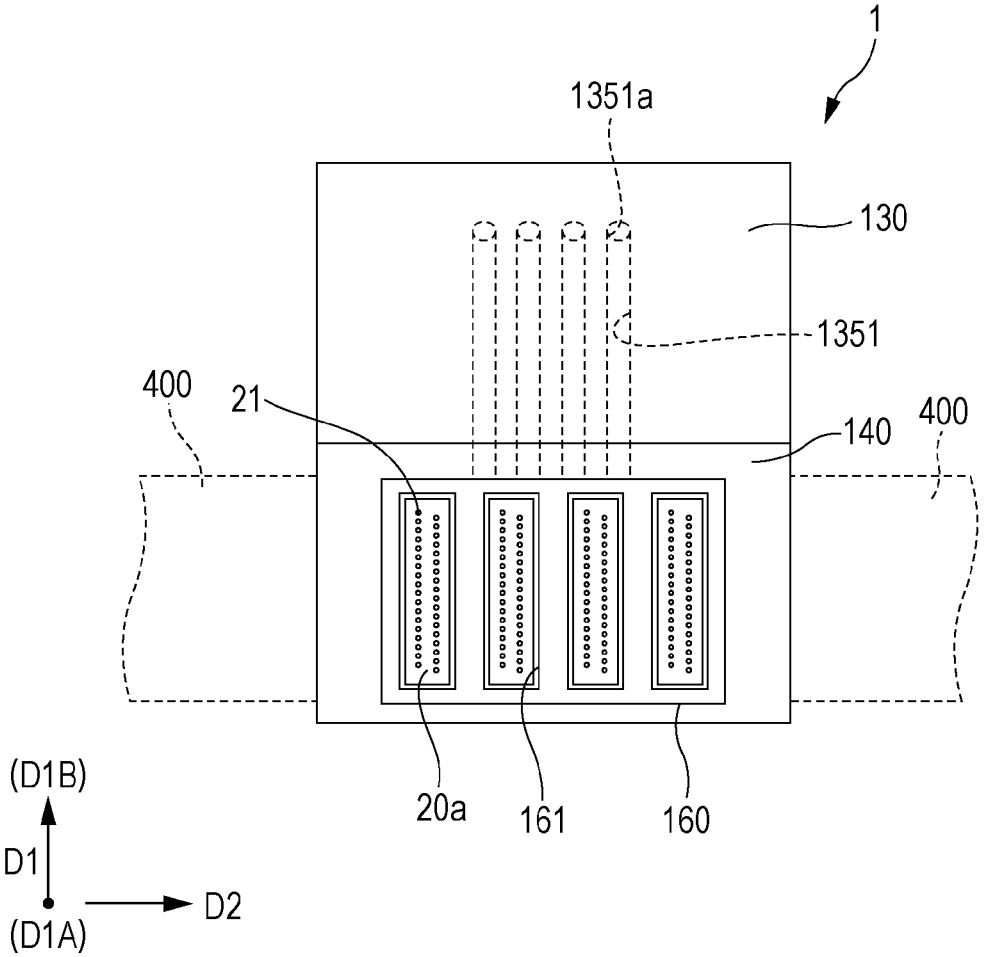
FIG. 3 is a plan view of the recording head according to the first embodiment of the invention.

First, an ink jet recording head which is an example of a liquid ejecting head according to a first embodiment of the invention will be described. In addition, FIG. 1 is a perspective view of an ink jet recording head as an example of the liquid ejecting head according to the first embodiment of the invention, FIG. 2 is an exploded perspective view of the ink jet recording head, and FIG. 3 is a plan view of the ink jet recording head on the liquid ejecting face side.

As illustrated, an ink jet recording head 1 includes a flow path member 130, a holding member 140 which is fixed to the flow path member 130, a plurality of head main bodies 150 which are fixed to the holding member 140, and a cover head 160 which covers the liquid ejecting face side of the head main body 150.

Figure 4:
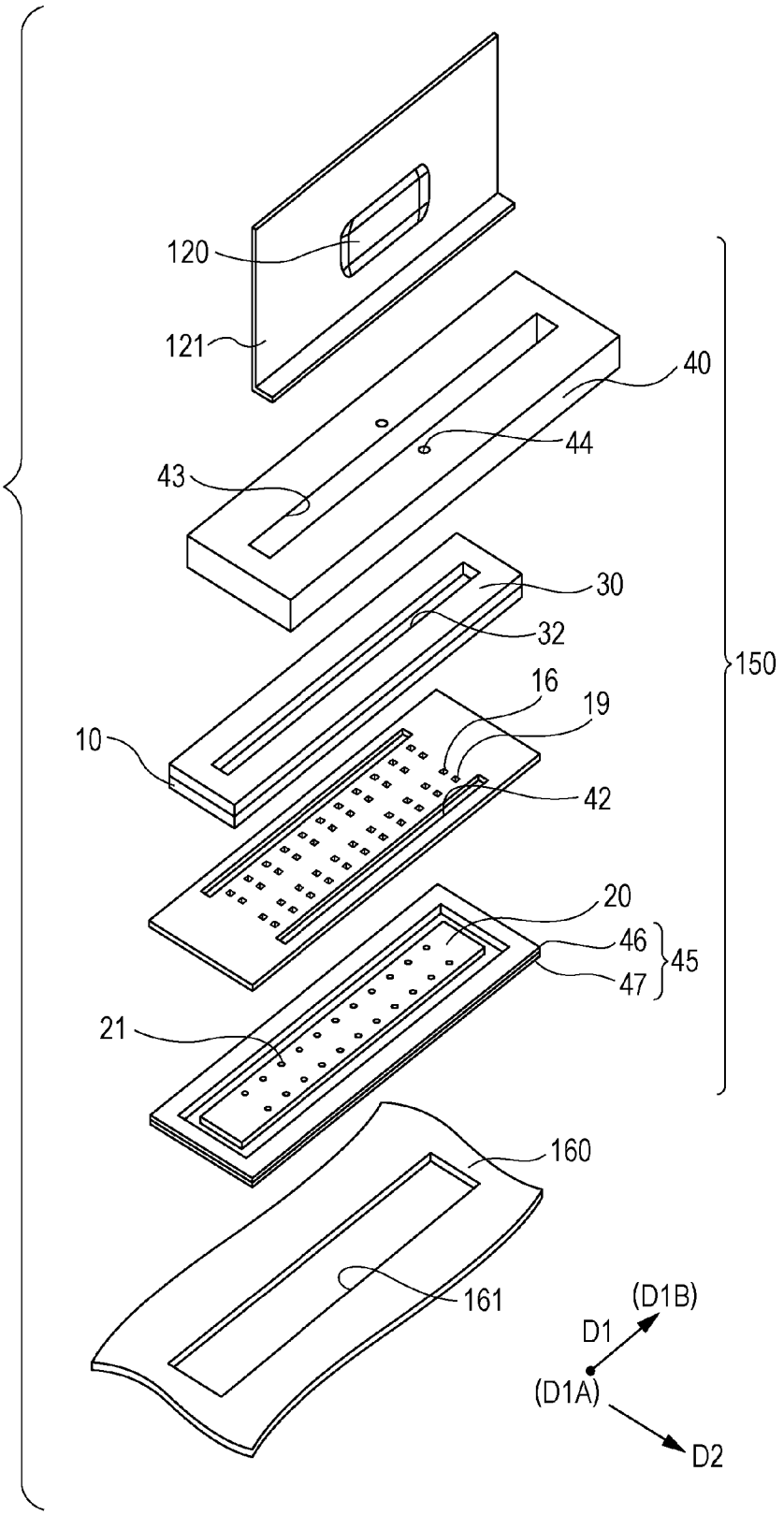
FIG. 4 is an exploded perspective view of a head main body according to the first embodiment of the invention.
Figure 5:
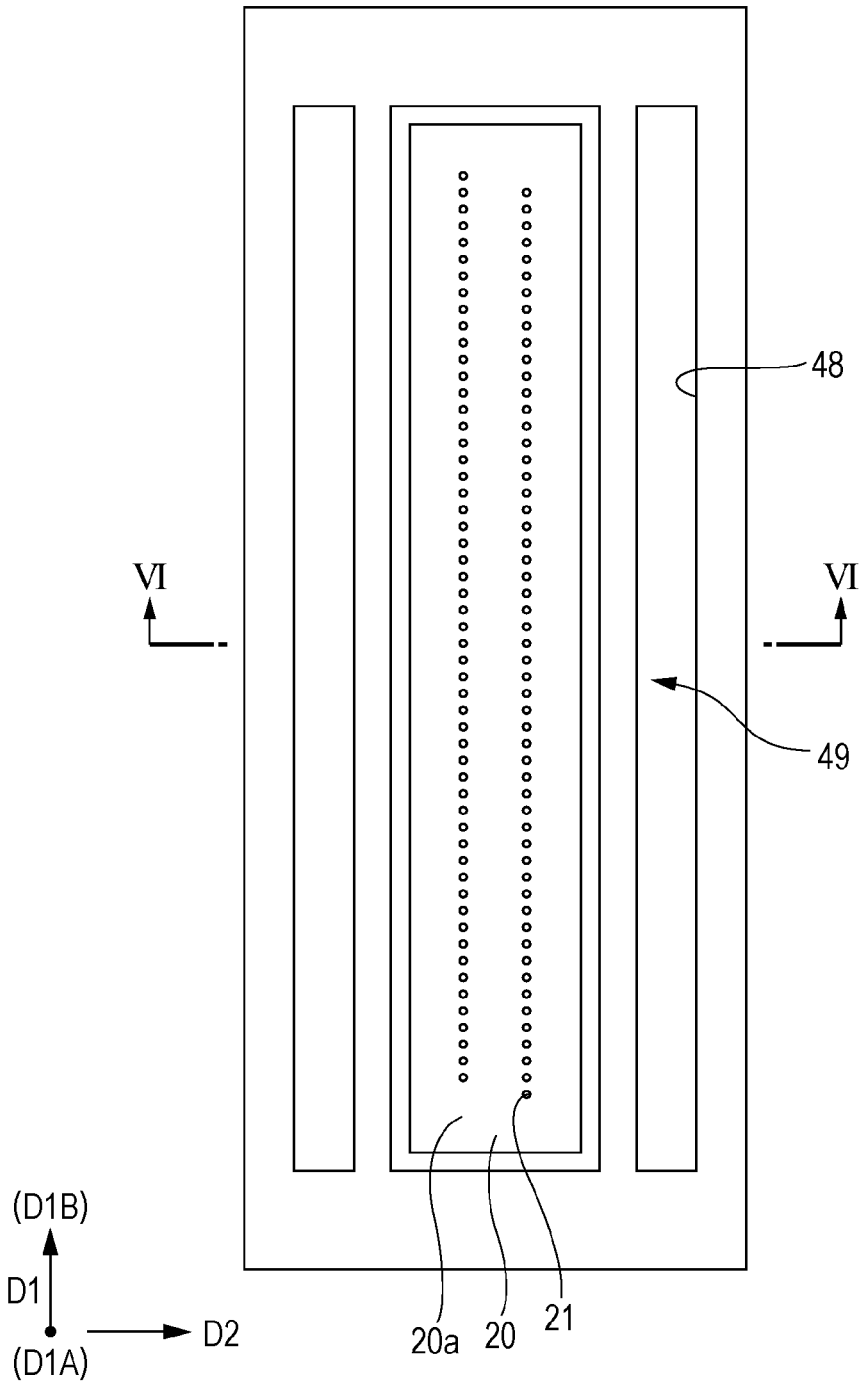
FIG. 5 is a plan view of the head main body according to the first embodiment of the invention.
Figure 6:
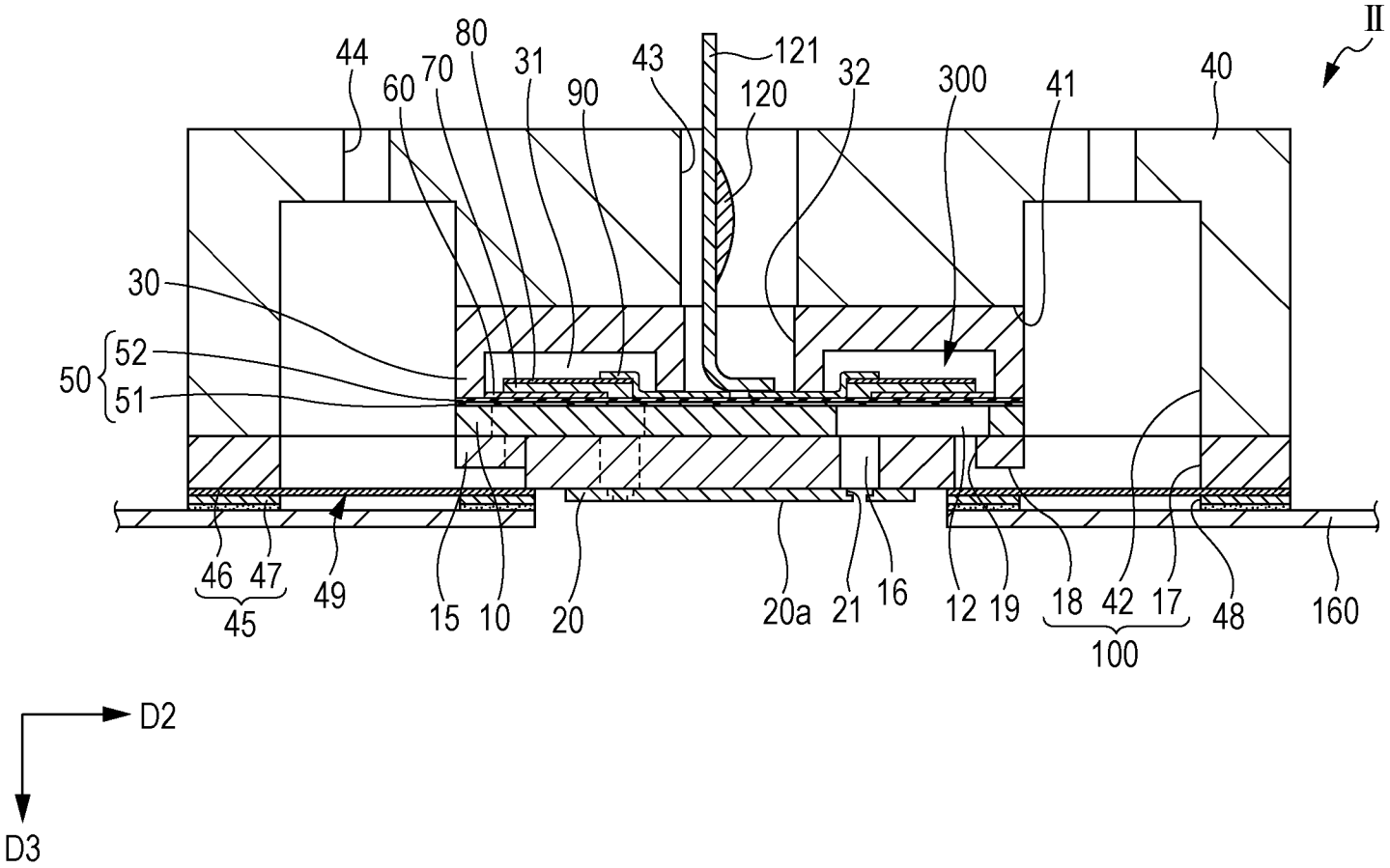
FIG. 6 is a cross-sectional view of the head main body according to the first embodiment of the invention.

First, the head main body 150 will be described in detail with reference to FIGS. 4 and 5. In addition, FIG. 4 is an exploded perspective view of the head main body, FIG. 5 is a plan view of the head main body on the liquid ejecting face side, and FIG. 6 is a cross-sectional view which is taken along line VI-VI of FIG. 5.

As illustrated, the head main body 150 according to the embodiment includes a plurality of members such as a flow path forming substrate 10, a communication plate 15, a nozzle plate 20, a protection board 30, and a case member, and these plurality of members are bonded using an adhesive, or the like.

In the flow path forming substrate 10, it is possible to use metal such as stainless steel, Ni, a ceramic material which is represented by $ZrO_2$ or $Al_2O_3$, a glass ceramic material, and an oxide such as MgO and $LaAlO_3$. According to the embodiment, the flow path forming substrate 10 is formed of a silicon single crystal substrate. In the flow path forming substrate 10, pressure generation chambers 12 which are partitioned by a plurality of partitioning walls are aligned in a direction in which a plurality of nozzle openings 21 which eject ink are aligned by performing anisotropic etching from one surface side. Hereinafter, this direction will be referred to as an aligning direction of the pressure generation chamber 12, or a first direction D1. In addition, according to the embodiment, in the first direction D1, specifically, one end side to which a flow path member 130 which will be described later protrudes rather than a holding member 140 is referred to as a D1A side, and the other end side on the opposite side is referred to as a D1B side. In addition, in the flow path forming substrate 10, a plurality of columns of the pressure generation chamber 12 are aligned in the first direction D1, for example, two columns in the embodiment. Hereinafter, a direction in which a plurality of columns of the columns of the pressure generation chamber 12 which are formed of the pressure generation chambers 12 aligned in the first direction D1 are aligned is referred to as a second direction D2. In addition, in the embodiment, a direction intersecting both the first direction D1 and the second direction D2 is referred to as a third direction D3. In addition, according to the embodiment, for ease of description, a relationship between directions (D1, D2, and D3) is set to be orthogonal; however, an arrangement relationship in each configuration may not necessarily be orthogonal. In addition, according to the embodiment, in the two columns of pressure generation chamber 12 which are aligned in the first direction D1, a column of the pressure generation chamber 12 on the other side is arranged at a position of being shifted in the first direction D1 by a half of an interval with a neighboring pressure generation chamber 12 in the first direction D1 with respect to a column of the pressure generation chamber 12 on one side. In this manner, specifically, two columns of the nozzle opening 21, which will be described later, are also arranged by being shifted in the first direction D1 by a half interval, and increases the resolution in the first direction D1 by two times. As a matter of course, different ink may be supplied to each column of the pressure generation chamber 12, by setting positions of the two columns of the pressure generation chamber 12 in the first direction D1 to be the same.

In addition, a communication plate 15 is bonded to one surface side of the flow path forming substrate 10 (stacked direction and third direction D3). In addition, the nozzle plate 20 onto which the plurality of nozzle openings 21 which communicate with each pressure generation chamber 12 are provided in a protruding manner is bonded onto the communication plate 15.

A nozzle communication path 16 which communicates with the pressure generation chamber 12 and the nozzle opening 21 is provided on the communication plate 15. The communication plate 15 has an area which is larger than the flow path forming substrate 10, and the nozzle plate 20 has an area which is smaller than the flow path forming substrate 10. In this manner, it is possible to reduce cost by making the area of the nozzle plate 20 relatively small. According to the embodiment, a face from which ink droplets are discharged when the nozzle opening 21 of the nozzle plate 20 is open is referred to as a liquid ejecting face 20*a*.

In addition, a first manifold unit 17 which configures a part of a manifold 100, and a second manifold unit (throttling flow path, orifice flow path) 18 are provided on the communication plate 15.

The first manifold unit 17 is provided by penetrating the communication plate 15 in a thickness direction (stacked direction of communication plate 15 and flow path forming substrate 10).

In addition, the second manifold unit 18 is provided by opening to the nozzle plate 20 side of the communication plate 15, without penetrating the communication plate 15 in the thickness direction.

In addition, in the communication plate 15, a supply communication flow path 19 which communicates with one end portion of the pressure generation chamber 12 in the second direction D2 is independently provided in each pressure generation chamber 12. The supply communication flow path 19 communicates with the second manifold unit 18 and the pressure generation chamber 12.

As the communication plate 15, it is possible to use metal such as stainless steel or Ni, or a ceramic such as zirconium. In addition, it is preferable to use a material of which a coefficient of linear expansion is the same as that of the flow path forming substrate 10 in the communication plate 15. That is, when a material of which a coefficient of linear expansion is remarkably different from that of the flow path forming substrate 10 is used, as a material of the communication plate 15, warpage occurs due to a difference in coefficient of linear expansion between the flow path forming substrate 10 and the communication plate 15 when being heated or cooled down. According to the embodiment, it is possible to suppress an occurrence of warpage, cracking, separation, or the like, due to heat using the same material as that of the flow path forming substrate 10, that is, a silicon single crystal substrate, as a material of the communication plate 15.

In addition, the nozzle openings 21 which communicate with each pressure generation chamber 12 through a nozzle communication path 16 are formed on the nozzle plate 20. That is, the nozzle openings 21 which eject the same liquid (ink) are aligned in the first direction D1, and two columns of the columns of the nozzle openings 21 (nozzle column) which are aligned in the first direction D1 are formed in the second direction D2. According to the embodiment, one face of the nozzle plate 20 in the third direction D3 to which the nozzle opening 21 is open is referred to as the liquid ejecting face 20*a*. In addition, a direction orthogonal to a face direction of the liquid ejecting face 20*a*, that is, the third direction D3 in the embodiment is a liquid ejecting direction from which ink is ejected.

As a material of the nozzle plate 20, for example, it is possible to use metal such as stainless steel (SUS), an organic substance such as a polyimid resin, or the silicon single crystal substrate, or the like. In addition, when using the silicon single crystal substrate as the nozzle plate 20, a coefficient of linear expansion in the nozzle plate 20 and the communication plate 15 becomes the same, and accordingly, it is possible to suppress the occurrence of warpage due to heating or cooling down, or cracking and separation due to heat.

Meanwhile, a vibrating plate 50 is formed on the opposite face side to the communication plate 15 of the flow path forming substrate 10. According to the embodiment, as the vibrating plate 50, an elastic film 51 which is formed of silicon oxide which is provided on the flow path forming substrate 10 side, and an insulator film 52 which is formed of zirconium oxide which is provided on the elastic film 51 are provided. In addition, a liquid flow path of the pressure generation chamber 12, or the like, is formed by performing anisotropic etching with respect to one surface side (face side onto which nozzle plate 20 is bonded) of the flow path forming substrate 10, and the other face of the liquid flow path of the pressure generation chamber 12, or the like, is demarcated using the elastic film 51.

In addition, according to the embodiment, on the insulator film 52 of the vibrating plate 50, a first electrode 60, a piezoelectric layer 70, and a second electrode 80 configure a piezoelectric actuator 300 by being stacked using a film forming method and a lithography method. Here, the piezoelectric actuator 300 is a portion which includes the first electrode 60, the piezoelectric layer 70, and the second electrode 80. In general, the piezoelectric actuator 300 is configured by setting any one of the electrodes to a common electrode, and by patterning the other electrode and the piezoelectric layer 70 in each pressure generation chamber 12. In addition, here, a portion which is configured of any one of the electrode which is patterned and the piezoelectric layer 70, and in which piezoelectric strain occurs due to applications of voltage to both electrodes is referred to as a piezoelectric active portion. According to the embodiment, the first electrode 60 is set to a common electrode of the piezoelectric actuator 300, and the second electrode 80 is set to an individual electrode of the piezoelectric actuator 300; however, there is no problem when being reversely set due to circumstances of a driving circuit and wiring. In addition, in the above described example, the first electrode 60 functions as the vibrating plate, since the first electrode 60 is continuously provided over the plurality of pressure generation chambers 12; however, as a matter of course, there is no limitation to this, and for example, only the first electrode 60 may be operated as the vibrating plate without providing any one or both of the above described elastic film 51 and the insulator film 52.

In addition, the protection board 30 of which a size is approximately the same as that of the flow path forming substrate 10 is bonded onto a face on the piezoelectric actuator 300 side of the flow path forming substrate 10. The protection board 30 includes a holding portion 31 which is a space for protecting and accommodating the piezoelectric actuator 300. In addition, a through hole 32 for penetrating in the third direction D3 which is the thickness direction is provided on the protection board 30. The other end portion of the lead electrode 90 which is the opposite side to one end portion connected to the second electrode 80 is extended so as to be exposed into the through hole 32, and a lead electrode 90 and a wiring member 121 on which a driving circuit 120 such as a driving IC is mounted are electrically connected in the through hole 32.

In addition, a case member 40 which demarcates the manifold 100 which communicates with the plurality of pressure generation chambers 12 along with the head main body 150 is fixed in the head main body 150 which is configured in this manner. The case member 40 has approximately the same shape as the above described communication plate 15 when planarly viewed, is bonded to the protection board 30, and is also bonded to the above described communication plate 15. Specifically, the case member 40 includes a convex portion 41 with a depth in which the flow path forming substrate 10 and the protection board 30 are accommodated on the protection board 30 side. The convex portion 41 has an opening area which is wider than a face of the protection board 30 which is bonded to the flow path forming substrate 10. In addition, an opening face on the convex portion 41 on the nozzle plate 20 side is sealed using the communication plate 15 in a state in which the flow path forming substrate 10, or the like, is accommodated in the convex portion 41. In this manner, a third manifold unit 42 is demarcated by the case member 40 and the head main body 150 on the outer peripheral portion of the flow path forming substrate 10. In addition, the manifold 100 according to the embodiment is configured of the first manifold unit 17 and the second manifold unit 18 which are provided on the communication plate 15, and the third manifold unit 42 which is demarcated by the case member 40 and the head main body 150.

In addition, as a material of the case member 40, it is possible to use, for example, a resin, metal, or the like. In addition, by molding a resin material as the case member 40, it is possible to perform mass production at a low cost.

In addition, a compliance board 45 is provided on a face of the communication plate 15 on which the first manifold unit 17 and the second manifold unit 18 are opened. The compliance board 45 seals openings of the first manifold unit 17 and the second manifold unit 18 on the liquid ejecting face 20*a* side.

According to the embodiment, the compliance board 45 includes a sealing film 46 and a fixing board 47. The sealing film 46 is formed of a flexible thin film (for example, thin film of which thickness is 20 μm or less, and which is formed using polyphenylene sulfide (PPS), stainless steel (SUS), or the like), and the fixing board 47 is formed of a hard material, for example, metal such as stainless steel (SUS). Since a region of the fixing board 47 facing the manifold 100 becomes an opening portion 48 which is completely eliminated in the thickness direction, one side face of the manifold 100 becomes a compliance unit which is a flexible unit sealed using only the sealing film 46 which is flexible.

In addition, an introducing path 44 for supplying ink to each manifold 100 by communicating with the manifold 100 is provided in the case member 40. According to the embodiment, since two independent manifolds 100 are provided in one head main body 150, two introducing paths 44 in total are provided in each manifold 100. In addition, a connection port 43 into which the wiring member 121 is inserted is provided by communicating with the through hole 32 of the protection board 30 in the case member 40.

The head main body 150 with such a configuration takes ink in from the introducing path 44 through a flow path member 130 from the ink carriage 2, when ejecting ink, and fills the inside of the flow path from the manifold 100 to the nozzle opening 21 with ink. Thereafter, the vibrating plate 50 is caused to perform flexural deformation along with the piezoelectric actuator 300 by applying a voltage to each piezoelectric actuator 300 corresponding to the pressure generation chamber 12 according to a signal from the driving circuit 120. In this manner, pressure in the pressure generation chamber 12 increases, and ink droplets are ejected from a predetermined nozzle opening 21.

As illustrated in FIGS. 1 to 3, four head main bodies 150 are fixed to the holding member 140 in an aligning direction of the nozzle column, that is, in the second direction D2 at a predetermined interval. That is, eight nozzle columns in which nozzle openings 21 are aligned are provided in the ink jet recording head 1 according to the embodiment. It is possible to suppress a decrease in yield compared to a case in which a plurality of nozzle columns are formed in one head main body 150, by providing a plurality of nozzle columns using a plurality of head main bodies 150 in this manner. In addition, it is possible to increase the number of head main bodies 150 which can be formed from one silicon wafer using a plurality of head main bodies 150 by providing a plurality of nozzle columns, and to reduce a manufacturing cost by reducing a useless region in the silicon wafer.

Here, the holding member 140 will be described in detail with reference to FIGS. 7 and 8. In addition, FIG. 7 is an exploded perspective view which illustrates a main portion of the ink jet recording head, and FIG. 8 is a cross-sectional view which illustrates a main portion of the ink jet recording head.

Figure 7:
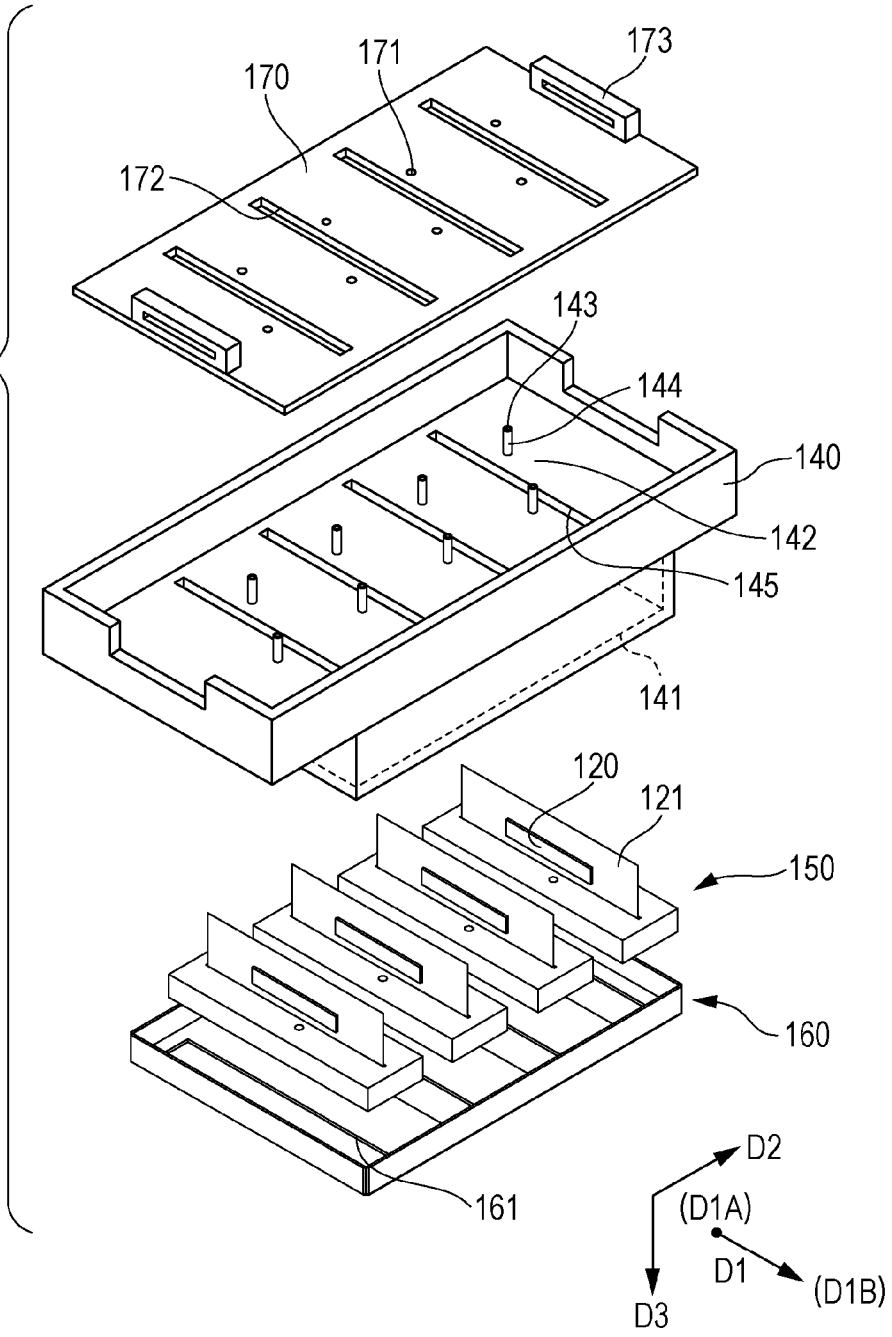
FIG. 7 is an exploded perspective view of a main portion of the recording head according to the first embodiment of the invention.
Figure 8:
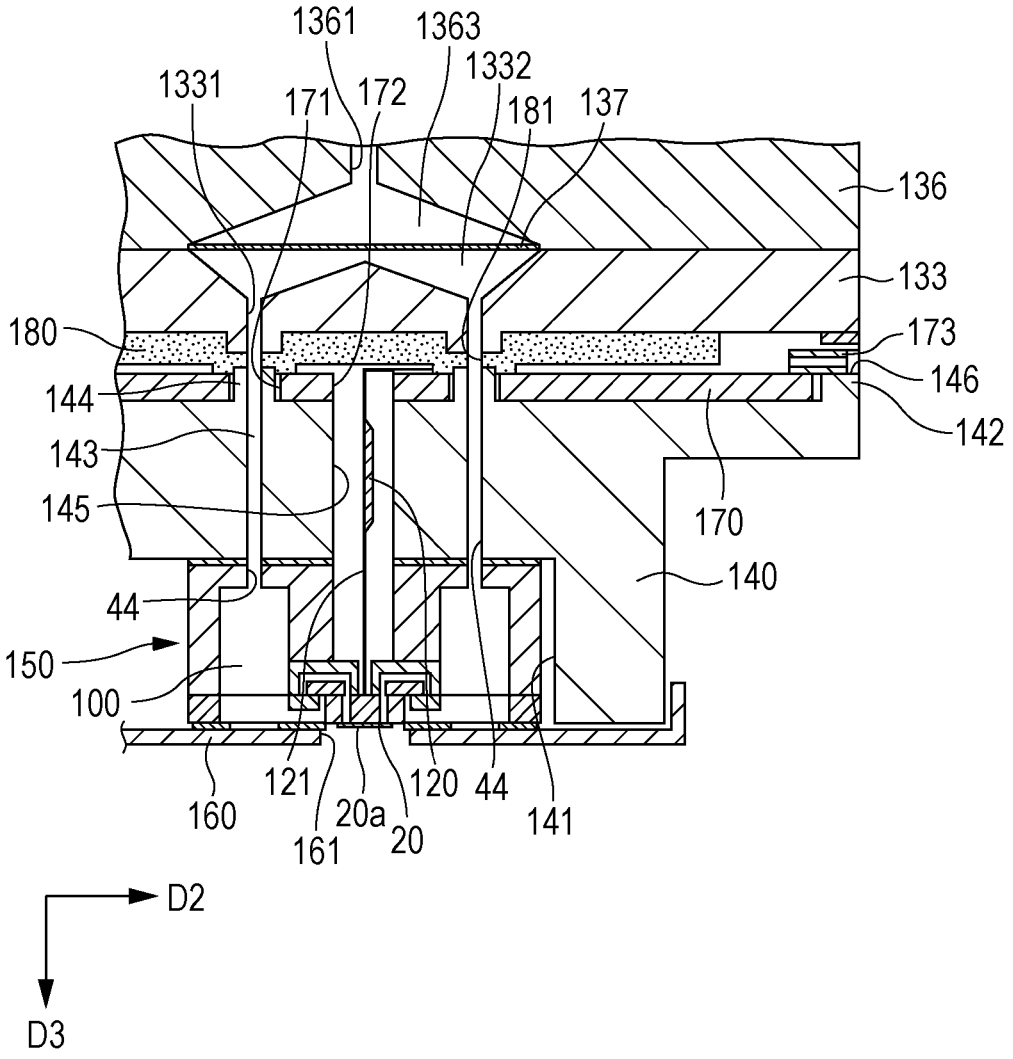
FIG. 8 is a cross-sectional view of a main portion of the recording head according to the first embodiment of the invention.

As illustrated in FIG. 7, a head main body holding unit 141 in which the head main body 150 is accommodated and held is provided on one face side (recording sheet S side) of the holding member 140 in the third direction D3. The head main body holding unit 141 has a concave shape which is opened on a face on the recording sheet S side of the holding member 140. According to the embodiment, the head main body holding unit 141 is formed in a size which can accommodate four head main bodies 150. In addition, four head main bodies 150 are accommodated in the head main body holding unit 141. According to the embodiment, the liquid ejecting face 20*a* of the case member 40 of the head main body 150 is held in the head main body holding unit 141 when an opposite face thereof is fixed to a base of the head main body holding unit 141.

In addition, a cover head 160 which covers an opening of the head main body holding unit 141 is provided on a face of the holding member 140 on the head main body holding unit 141 side.

The cover head 160 is formed of a plate shaped member which includes an exposure opening unit 161 which exposes the liquid ejecting face 20*a* of the head main body 150. Four exposure opening units 161 are formed so as to expose the liquid ejecting face 20*a* of each head main body 150 independently (refer to FIG. 6). According to the embodiment, the exposure opening unit 161 has an opening of a size which exposes the nozzle plate 20, that is, the same opening as that of the compliance board 45.

The cover head 160 is bonded to a side opposite to the communication plate 15 of the compliance board 45, and prevents ink from attaching to a compliance unit 49.

In addition, as illustrated in FIGS. 7 and 8, a wiring board holding unit 142 which accommodates a wiring board 170 therein is provided on the other face side of the holding member 140 in the third direction D3, that is, on the flow path member 130 side. The wiring board 170 is arranged in the wiring board holding unit 142 facing the third direction D3 which is an ejecting direction of ink. That is, the wiring board 170 is formed of a rigid substrate in the embodiment, and the wiring board 170 is accommodated in the wiring board holding unit 142 so that the wiring board forms a face direction including the first direction D1 and the second direction D2.

The wiring board holding unit 142 is provided so as to protrude to both sides in the second direction D2 compared to the head main body holding unit 141. That is, the wiring board 170 has a width larger than the four head main bodies 150 which are held, in the second direction D2. Accordingly, the wiring board holding unit 142 which holds the wiring board 170 is provided so as to protrude to both sides in the second direction D2 compared to the head main body holding unit 141 which accommodates four head main bodies 150. In addition, the width of the wiring board 170 in the first direction D1 is approximately the same as the width of the head main body holding unit 141 in the first direction D1, that is, the head main body 150. Though it will be described in detail later, an opening of the wiring board holding unit 142 on the side opposite to the liquid ejecting face 20*a* in the third direction D3 is sealed using the flow path member 130. Due to this, the wiring board 170 is accommodated in the wiring board holding unit 142 of the holding member 140. In this manner, it is possible to suppress a short circuit of wiring, a failure in an electronic component which is installed, or the like, due to attaching of ink to the wiring board 170, by accommodating the wiring board 170 in holding member 140.

In addition, a connection flow path 143 for supplying ink which is supplied from the flow path member 130 to the head main body 150 is provided in the holding member 140. According to the embodiment, the connection flow path 143 is provided in each introducing path 44 of the head main body 150. That is, since two introducing paths 44 are provided in one head main body 150, eight connection flow paths 143 in total are provided with respect to four head main bodies 150. In addition, the connection flow path 143 is provided so as to open on an end face of a first protrusion unit 144 of which one end is provided in the wiring board holding unit 142 in a protruding manner. In addition, the other end of the connection flow path 143 is provided so as to open on a base of the head main body holding unit 141. The one end which is open on the end face of the first protrusion unit 144 is connected to the flow path member 130, and the other end which is open on the base of the head main body holding unit 141 is connected to the introducing path 44 of the head main body 150. In this manner, ink from the flow path member 130 is supplied to the head main body 150 through the connection flow path 143.

In addition, in the holding member 140, a wiring member insertion hole 145 into which the wiring member 121 is inserted is provided between the two connection flow paths 143 which are provided in each head main body 150 in the first direction D1. The wiring member insertion hole 145 is a hole which is inserted in the connection port 43 of the head main body 150, and a hole for inserting the wiring member 121 to the flow path member 130 side from the head main body 150 side. The wiring member insertion hole 145 is provided with an opening with approximately the same width as the width of the head main body 150 in the first direction D1.

In addition, a first insertion hole 171 into which the first protrusion unit 144 is inserted, and a second insertion hole 172 into which the wiring member 121 is inserted are provided on the wiring board 170. In addition, the wiring member 121 which is inserted in the second insertion hole 172 is connected to the wiring board 170 on a face on the side opposite to the liquid ejecting face 20*a*. In addition, a connection method between the wiring board 170 and the wiring member 121 is not particularly limited, and it is possible to use, for example, soldering and brazing, eutectic bonding, welding, a conductive adhesive including conductive particles (ACP, ACF), a non-conductive adhesive (NCP, NCF), and the like.

In addition, connectors 173 are provided on both end portions of the wiring board 170 in the second direction D2. According to the embodiment, the connector 173 is fixed to the opposite face side to the head main body 150 of the wiring board 170 in the third direction D3. In addition, in the holding member 140, a connection hole 146 which communicates with the wiring board holding unit 142 and the outside is provided on a side wall which faces the connector 173, and the connector 173 is exposed to the outside using the connection hole 146. In this manner, a flexible substrate 400 as a flexible substrate such as FPC, FFC, or the like, is connected to the connector 173 from the outside of the ink jet recording head 1 (refer to FIG. 1). That is, the flexible substrate 400 which is external wiring connected to the connector 173 in the embodiment is derived in the second direction D2 of the ink jet recording head 1. In addition, according to the embodiment, it will be described in detail later; however, since the ink jet recording head 1 is installed so that the second direction D2 becomes a Y direction intersecting the transport direction X of the ink jet recording apparatus I, a deriving direction of the flexible substrate 400 becomes the Y direction in an ink jet recording apparatus I.

As illustrated in FIGS. 1 to 3, the flow path member 130 is bonded to the wiring board holding unit 142 side of the holding member 140.

Here, the flow path member 130 will be described with reference to FIGS. 1 to 3. As illustrated, the flow path member 130 includes a case member 131, and a flow path forming member 135 which is accommodated in the case member 131.

The case member 131 has a hollow box shape, and is configured of two members which are divided into a first case member 132 and a second case member 133, and are fixed. An accommodation unit 134 which is a space is formed in the case member 131, and the flow path forming member 135 is accommodated in the accommodation unit 134.

The flow path forming member 135 which is accommodated in the case member 131 is not particularly illustrated; however, for example, the flow path forming member 135 which is accommodated in the case member is a function member in which each function unit such as a filter for eliminating air bubbles or foreign substances which are contained in ink, and a valve for opening and closing a flow path according to a pressure of ink in the flow path are provided. In addition, a heating unit such as a heater may be provided in the flow path forming member 135. The flow path forming member 135 according to the embodiment is configured by stacking a plurality of members, for example, three members in the third direction D3. A flow path 1351 is provided in the flow path forming member 135, and one end of the flow path 1351 is provided so as to open on the first case member 132 side, and becomes an ink supply port 1351*a* to which ink is supplied. In addition, though it is not particularly illustrated, the other end of the flow path 1351 is provided so as to open on the second case member 133 side. In addition, according to the embodiment, the ink supply port 1351*a* is provided on one end side of the flow path forming member 135 in the first direction D1, and the other end of the flow path 1351 is arranged at a position of overlapping with the holding member 140 when viewed the recording sheet S planarly, that is, when viewed the sheet planarly in the third direction D3. In this manner, it is possible to supply ink from the flow path 1351 to the head main body 150 through the holding member 140.

An opening portion 1321 which exposes the ink supply port 1351*a* is provided in the first case member 132. Ink is supplied when the ink carriage 2 is connected to the ink supply port 1351*a* which is exposed using the opening portion 1321 directly, or through other flow path members or a supply pipe such as a tube.

In addition, as illustrated in FIG. 8, a supply member 136 is provided between the second case member 133 and the flow path forming member 135.

In the supply member 136, a first supply flow path 1361 which communicates with the flow path 1351 of the flow path forming member 135 (refer to FIG. 3), and communicates with the holding member 140 is provided. The first supply flow path 1361 is provided so as to open on an end face of a second protrusion unit 1362 of which one end is provided on the flow path forming member 135 side in a protruding manner. In addition, the other end of the first supply flow path 1361 is provided so as to open on the second case member 133 side, and first liquid reservoir 1363 of which an inner diameter is widened on the second case member 133 side.

A second supply flow path 1331 is provided in the second case member 133. An opening portion of the second supply flow path 1331 on the supply member 136 becomes a second liquid reservoir 1332 which is widened corresponding to the first liquid reservoir 1363, and a filter 137 for eliminating air bubbles or foreign substances which are contained in ink is provided at an opening portion of the second liquid reservoir 1332 (between first liquid reservoir 1363 and second liquid reservoir 1332). In this manner, ink which is supplied from the first supply flow path 1361 is supplied to the second supply flow path 1331 through the filter 137.

In addition, the second supply flow path 1331 is branched to two flow paths on the downstream side of the second liquid reservoir 1332 (holding member 140 side). That is, according to the embodiment, four first supply flow paths 1361 are provided in the supply member 136, and eight second supply flow paths 1331 are provided in the second case member 133. That is, four ink supply ports 135*a* of the flow path forming member 135 are formed similarly to the first supply flow path 1361.

In this manner, by reducing the number of first supply flow paths 1361 which are on the upstream side of the filter 137, it is possible to prevent the flow path member 130 from becoming large in order to secure a region for forming the first supply flow path 1361. In addition, by providing one common filter 137 with respect to the two second supply flow paths 1331 which are on the downstream side of the filter 137, it is possible to make the flow path member 130 small by reducing an area for bonding the filter 137, or a space for providing a wall, or the like, for separating neighboring first liquid reservoirs 1363 (second liquid reservoir 1332) so as not to communicate with each other.

The flow path member 130 is fixed to the wiring board holding unit 142 of the holding member 140. In addition, a sealing member 180 in which a connection communication path 181 which connects the connection flow path 143 and the second supply flow path 1331 is provided between the holding member 140 and the flow path member 130. The connection flow path 143 and the second supply flow path 1331 are connected in a state of being sealed using the sealing member 180.

In addition, the width of the flow path member 130 in the first direction D1 is larger than the width of the holding member 140. As described above, the reason for this is that, since the flow path forming member 135 is a function member in which each function unit such as the filter, the valve, and the heating unit are provided inside thereof, it is necessary to provide a region for arranging each function unit, or a region for pulling around the flow path 1351 with respect to each function unit. That is, it is practically difficult to reduce the width of the flow path member 130 in the first direction D1 to the same width of the holding member 140, and when the holding member 140 side is increased in width up to the first direction D1 side which is the same as that the flow path member 130, it leads to a large size of the ink jet recording head 1, and in particular, a large size on the liquid ejecting face 20*a* side, and in particular, it is not possible to arrange a second transport unit 220 which will be described later at a desired position, and a distance between the first transport roller 211 and the second transport roller 221 increases.

Accordingly, the flow path member 130 in the embodiment is provided so as to protrude from the D1B side in the first direction D1 compared to the holding member 140. In addition, the flow path member 130 in the embodiment is provided so as to also protrude to the D1A side compared to the holding member 140 in the first direction D1; however, it is a protrusion for being installed in the carriage 3, and an amount of protrusion of the flow path member 130 from the holding member 140 on the D1B side becomes larger than that on the D1A side. Though it will be described in detail later, in the third direction D3, it is possible to form a space between the portion protruding to the D1B side compared to the holding member 140 of the flow path member 130 and the recording sheet S in this manner.

Figure 9:
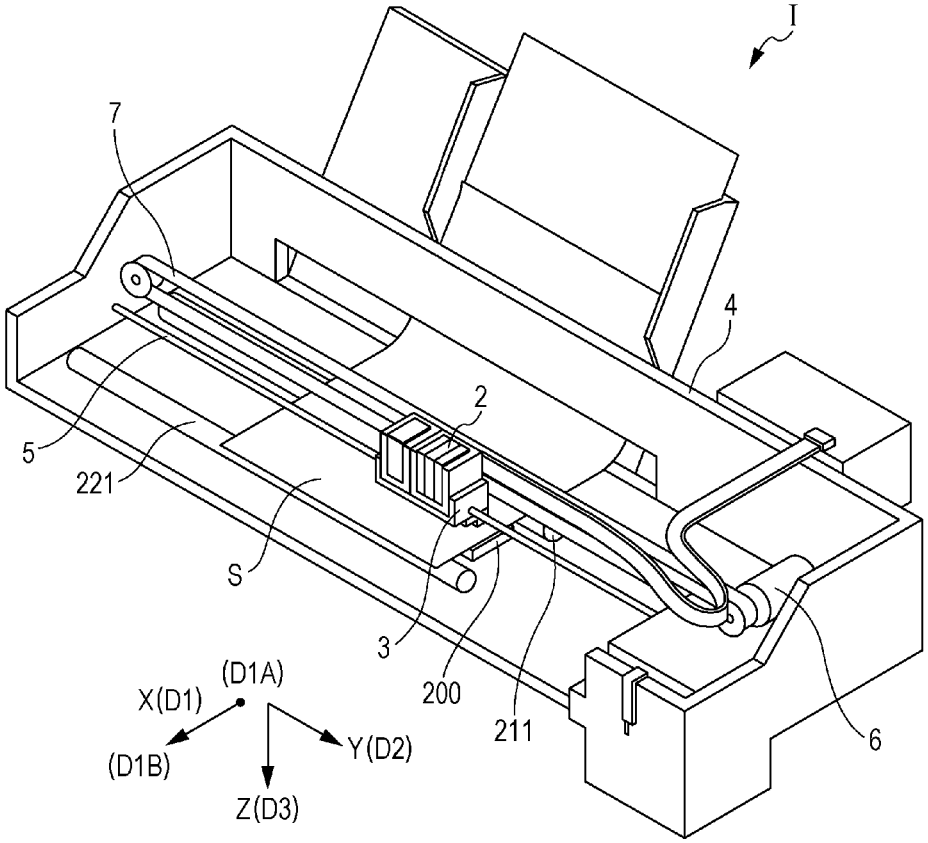
FIG. 9 is a schematic perspective view of a recording apparatus according to the first embodiment of the invention.

The ink jet recording head 1 is installed in an ink jet recording apparatus. Here, an example of the ink jet recording apparatus will be described. In addition, FIG. 9 is a schematic perspective view of an ink jet recording apparatus which is an example of the liquid ejecting apparatus according to the first embodiment of the invention, FIG. 10 is a plan view of a main portion of the ink jet recording apparatus, and FIG. 11 is a cross-sectional view which is taken along line XI-XI of FIG. 10.

As illustrated, the above described ink jet recording head 1 is installed in the carriage 3. The carriage 3 is provided so as to move in the axial direction of a carriage axis 5.

Here, though it will be described in detail later, the ink jet recording apparatus I includes a first transport unit 210 including the first transport roller 211, and a second transport unit 220 including the second transport roller 221, and the first transport roller 211 and the second transport roller 221 are arranged by being separated at an interval. The direction in which the first transport roller 211 and the second transport roller 221 are arranged by being separated at an interval becomes a transport direction in which the recording sheet S which is a medium for ejecting is transported, and according to the embodiment, the transport direction is referred to as a transport direction X (X direction). In addition, a direction in which rotation axes of the first transport roller 211 and the second transport roller 221 extend is referred to as a direction Y (Y direction) intersecting the transport direction X. In addition, a direction which intersects both the X direction and Y direction is referred to as a Z direction. In addition, according to the embodiment, for ease of description, a relationship among each direction (X, Y, and Z) is set to be orthogonal; however, the relationship arrangement of each configuration is not necessarily orthogonal.

Figure 10:
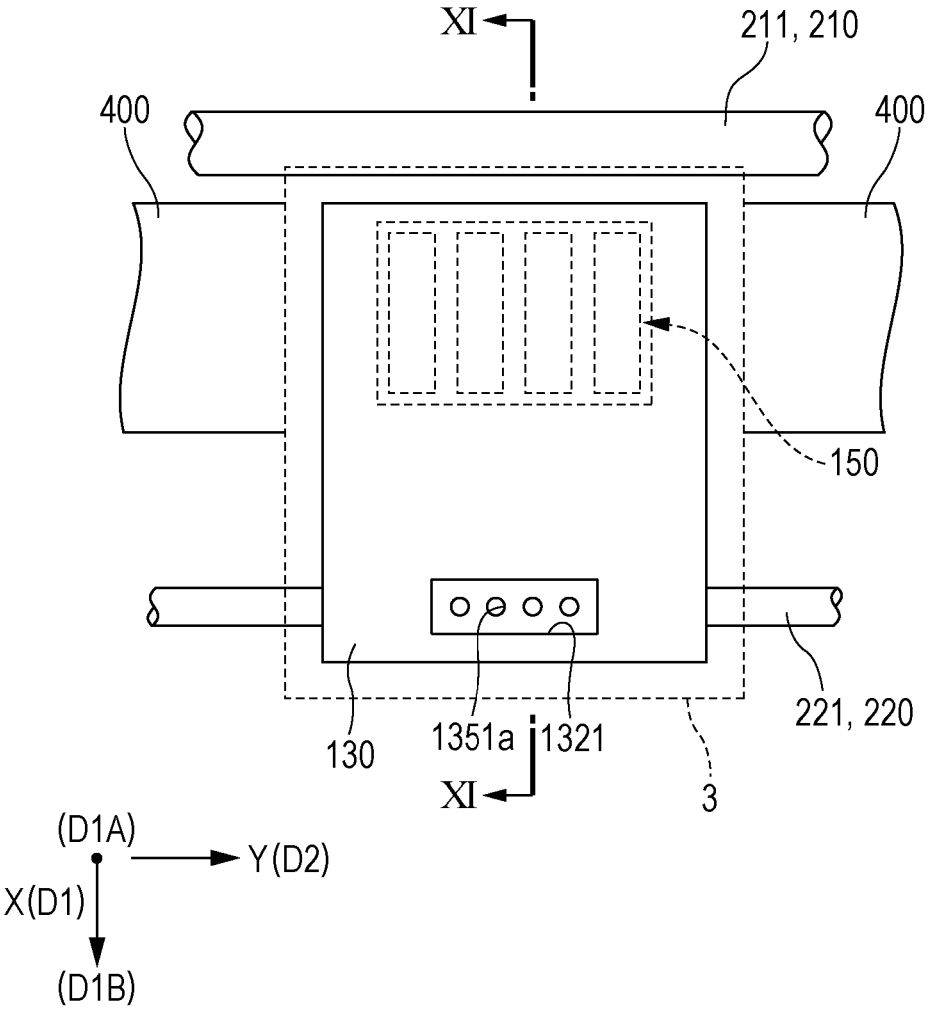
FIG. 10 is a plan view of the main portion of the recording apparatus according to the first embodiment of the invention.
Figure 11:
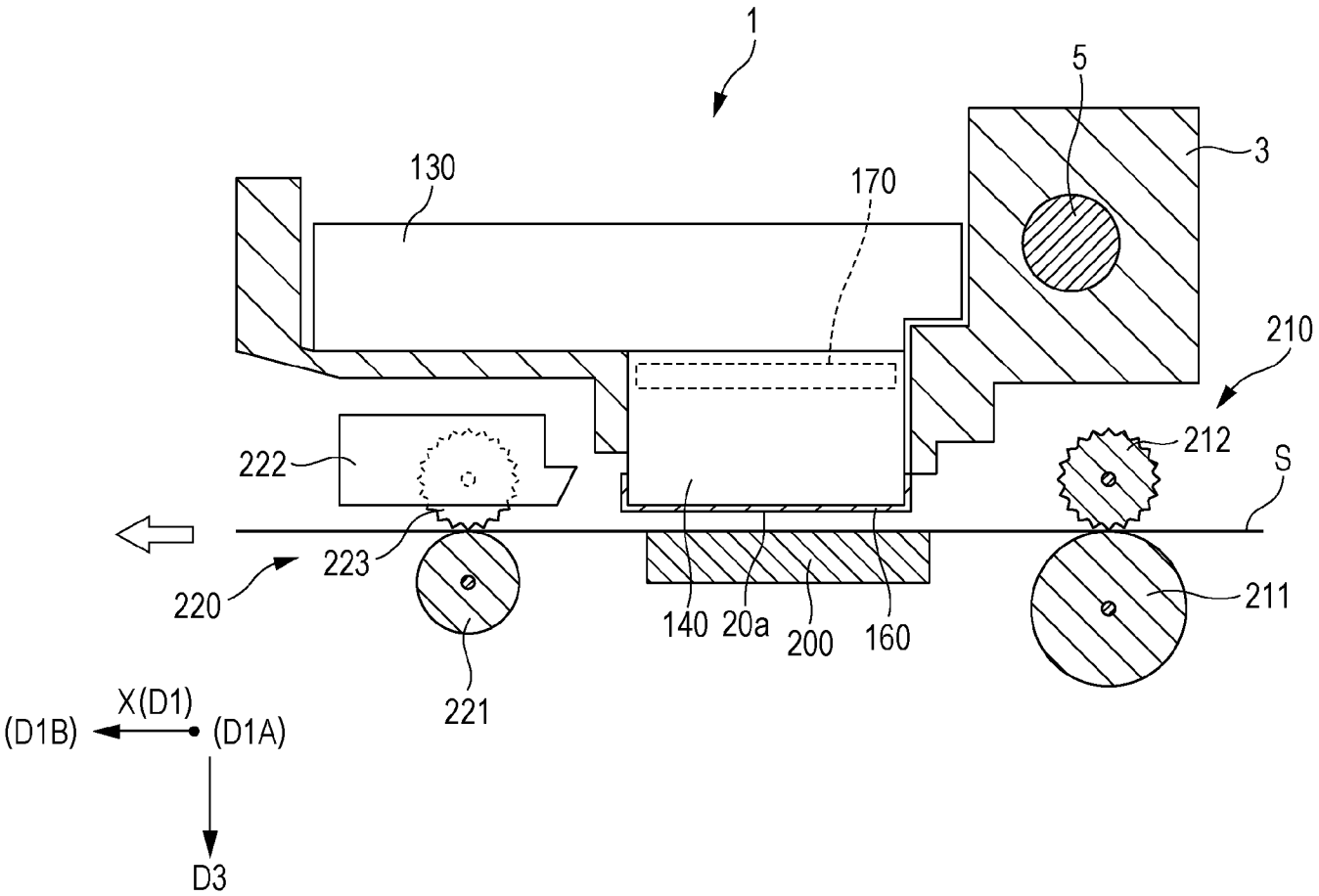
FIG. 11 is a cross-sectional view of the main portion of the recording apparatus according to the first embodiment of the invention.

In addition, as illustrated in FIG. 10, the ink jet recording head 1 according to the embodiment is installed in the carriage 3 so as to the first direction D1 match the transport direction X of the recording sheet S which is a medium for ejecting. That is, the ink jet recording head 1 is installed in the carriage 3 so that the second direction D2 matches the axial direction of the carriage axis 5, that is, the movement direction of the carriage 3. In addition, according to the embodiment, the movement direction of the carriage 3 (axis direction of carriage axis 5) is provided so as to match the Y direction. In addition, the third direction D3 which is the liquid ejecting direction of the ink jet recording head 1 matches the Z direction.

In addition, according to the embodiment, as illustrated in FIG. 10, the ink jet recording head 1 is arranged in the carriage 3 so that a side which protrudes from the holding member 140 of the flow path member 130 to the first direction D1 side becomes a downstream side of the recording sheet S in the transport direction X.

An ink carriage 2 which is a liquid storage unit for supplying ink to the ink jet recording head 1 is detachably provided in the carriage 3. In addition, according to the embodiment, a configuration in which the ink carriage 2 is installed in the carriage 3 has been exemplified; however, it is not particularly limited to this, and a configuration may be adopted in which a liquid storage unit such as an ink tank is fixed to an apparatus main body 4, and the liquid storage unit and the ink jet recording head 1 are connected through a supply tube such as a tube.

In addition, the carriage 3 on which the ink jet recording head 1 is installed moves in the Y direction along the carriage axis 5 when a driving force of a driving motor 6 is transmitted to the carriage 3 through a plurality of gears and a timing belt 7 which are not illustrated.

Meanwhile, a support member 200 which supports a face of the recording sheet S on which ink droplets land, that is, the rear face on the side opposite to a printing face is provided on the apparatus main body 4.

In addition, the apparatus main body 4 is provided with the first transport unit 210 which transports the recording sheet S at a position at which the recording sheet and the ink jet recording head 1 face each other, that is, on the support member 200 on one side of the recording sheet S in the transport direction X rather than the ink jet recording head 1, that is, on the upstream side in the transport direction X, in the apparatus main body 4.

In addition, the apparatus main body 4 is provided with the second transport unit 220 which transports the recording sheet S on the support member 200 toward the other side in the transport direction X on the other side of the recording sheet S in the transport direction X rather than the ink jet recording head 1, that is, on the downstream side in the transport direction X.

In this manner, the recording sheet S is transported onto the support member 200 from one side in the transport direction X using the first transport unit 210, and is supported by the support member 200, and ink droplets which are ejected from the ink jet recording head 1 land. In addition, the recording sheet S on which ink droplets land is discharged to the outside of the apparatus main body 4 using the second transport unit 220. In addition, according to the embodiment, a configuration is exemplified in which the first transport unit 210 is provided on the downstream side, and the second transport unit 220 is provided on the downstream side with respect to the ink jet recording head 1 in the transport direction X; however, the recording sheet S may be printed while performing reciprocating movement in the transport direction X. That is, the recording sheet S may be transported from the second transport unit 220 side to the first transport unit 210 side. In this case, in the transport direction X, the second transport unit 220 side becomes the upstream side, and the first transport unit 210 side becomes the downstream side.

Here, as described in FIG. 11, the first transport unit 210 includes the first transport roller 211 which is rotatably driven by a driving motor, or the like, which is not illustrated, and a first driven roller 212 which is driven following the first transport roller 211.

The first transport roller 211 is provided on the D1A side in the first direction D1 rather than the ink jet recording head 1 in the transport direction X. The first transport roller 211 is provided at a position not overlapping with the ink jet recording head 1 when the transported recording sheet S is planarly viewed, that is, when the recording sheet S is planarly viewed in the third direction D3 (Z direction) which is the liquid ejecting direction. That is, the first transport roller 211 is provided at a position not overlapping with the wiring board 170 of the ink jet recording head 1 when planarly viewed in the third direction D3. In other words, the ink jet recording head 1 and the first transport roller 211 are arranged at positions not facing each other in the third direction D3 which is the liquid ejecting direction. However, though it will be described in detail later, when the first transport roller 211 is arranged at a position of being separated from the ink jet recording head 1 in the transport direction X, a gap between the first transport roller 211 and the second transport roller 221 of the second transport unit 220 in the transport direction X becomes wide, and it is difficult to fix a posture of the recording sheet S which is held between the first transport roller 211 and the second transport roller 221. Accordingly, it is preferable that the first transport roller 211 be provided so as to be close to the ink jet recording head 1. Incidentally, for example, when the first transport roller 211 is arranged at a position at which the roller overlaps with the ink jet recording head 1, when planarly viewed in the third direction D3 (Z direction), it is possible to secure a space for arranging the first driven roller 212 which is driven following the first transport roller 211, and the ink jet recording head 1 and the first driven roller 212 interfere with each other. In addition, when the ink jet recording head 1 and the support member 200 are arranged by being separated from each other in the third direction D3 (Z direction) in order to secure the space for arranging the first driven roller 212, the gap between the liquid ejecting face 20*a* and the recording sheet S becomes wide, the ink jet recording apparatus I becomes large in the third direction D3 (Z direction), and there is a problem in that ejected ink droplets are shifted from a landing position, thus, it is not possible to execute high-speed printing, or the like. According to the embodiment, it is possible to execute miniaturization of the ink jet recording apparatus I, suppressing of a shift in landing position, and high-speed printing by arranging the first transport roller 211 at a position at which the roller does not overlap with the ink jet recording head 1, when planarly viewed in the third direction D3.

Meanwhile, the second transport unit 220 includes the second transport roller 221, a guide member 222, and a second driven roller 223 which is provided in the guide member 222, and is driven following the second transport roller 221.

The second transport roller 221 is rotatably driven using a driving unit such as a driving motor which is not illustrated. In addition, the second transport roller 221 is provided at a position at which the roller does not overlap with the ink jet recording head 1, and a position at which the roller does not overlap with the wiring board 170 of the ink jet recording head 1, when the transported recording sheet S is planarly viewed, that is, when the recording sheet is planarly viewed in the third direction D3. That is, the second transport roller 221 is arranged on the outside of a region at which the roller faces the wiring board 170, that is, a region not facing each other, in a region in which the second transport roller and the ink jet recording head 1 face each other in the third direction D3.

In this manner, by arranging the second transport roller 221 in a region in which the roller and the wiring board 170 do not face each other, in the region in which the roller and the ink jet recording head 1 face each other, it is possible to make a distance in the transport direction X of the recording sheet S from the first transport roller 211 and the second transport roller 221 short. In addition, by making the distance in the transport direction X of the recording sheet S from the first transport roller 211 and the second transport roller 221 short, it is easy to fix a posture of the recording sheet S between first transport roller 211 and the second transport roller 221, and it is possible to improve printing quality, and to perform high-speed printing. In addition, it is possible to miniaturize the ink jet recording apparatus I in the transport direction X. In contrast to this, when the second transport roller 221 is provided in a region in which the roller and the ink jet recording head 1 do not face each other in the third direction D3, similarly to the first transport roller 211, a distance between the first transport roller 211 and the second transport roller 221 increases, it is difficult to fix the posture of the recording sheet S between the first transport roller 211 and the second transport roller 221, printing quality deteriorates due to an occurrence of a shift in landing position, and it is not possible to perform high-speed printing.

In addition, when the ink jet recording head 1 is arranged by being separated from the support member 200 in the third direction D3 in order to secure a space for arranging a guide member 222 and the second driven roller 223, a gap between the liquid ejecting face 20*a* and the recording sheet S becomes large, the ink jet recording apparatus I becomes wide, and there is a problem in that the ink jet recording apparatus I becomes large in the third direction D3 (Z direction), ejected ink droplets are shifted from a landing position, it is not possible to execute high-speed printing, or the like. According to the embodiment, it is possible to secure a space for arranging the guide member 222 and the second driven roller 223 between the ink jet recording head 1 and the recording sheet S by arranging the second transport roller 221 in a region in which the roller does not face the wiring board 170 each other, in a region in which the roller and the ink jet recording head 1 face each other, without widening the gap between the liquid ejecting face 20*a* and the recording sheet S.

Specifically, as described above, in the ink jet recording head 1 according to the embodiment, the flow path member 130 is provided so as to protrude to the D1A side in the first direction D1 compared to the holding member 140 which holds the wiring board 170. Accordingly, the second transport roller 221 is arranged so as to face the ink jet recording head in a region which protrudes to the D1A side in the first direction D1 (X direction) compared to the holding member 140 of the flow path member 130 in the third direction D3 (Z direction). That is, since a space is formed between the region which protrudes to the D1A side in the first direction D1 (X direction) compared to the holding member 140 of the flow path member 130 and the recording sheet S, it is possible to arrange the guide member 222 and the second driven roller 223 in the space. That is, in the ink jet recording head 1 according to the embodiment, it is possible to arrange the guide member 222 and the second driven roller 223 in the space by making the width of the wiring board 170 in the first direction D1 smaller than that of the flow path member 130, and by forming the space between the flow path member 130 and the recording sheet S, without making the gap between the liquid ejecting face 20*a* and the recording sheet S large. In contrast to this, for example, when the width of the wiring board 170 in the first direction D1 is formed so as to be the same as that of the flow path member 130, it is necessary to form the width of the holding member 140 of the ink jet recording head 1 in the first direction D1 so as to be the same width as that of the flow path member 130. For this reason, it is not possible to secure the space for arranging the guide member 222 and the second driven roller 223 between the wiring board 170 and the recording sheet S. In addition, when the ink jet recording head 1 and the support member 200 are arranged so as to be separated in the third direction D3 (Z direction) in order to secure the space for arranging the guide member 222 and the second driven roller 223, the gap between the liquid ejecting face 20*a* and the recording sheet S becomes large, and there is a problem in that the ink jet recording apparatus I becomes large in the Z direction, ink droplets are shifted from a landing position, it is not possible to execute high-speed printing, or the like. In addition, an arrangement of the wiring board 170 of which the width in the first direction D1 is large at a position which is separated from the recording sheet S in the third direction D3 is taken into consideration without widening a gap between the liquid ejecting face 20*a* and the recording sheet S, in order to secure the space for arranging the second transport unit 220; however, in such a case, the ink jet recording head 1 becomes large in the third direction D3. In addition, when the head main body 150 and the wiring board 170 are arranged so as to be separated from each other, the wiring member 121 for connecting these should be long. Since the wiring member 121 is an expensive component, when the wiring member 121 becomes long, it leads to a high cost.

According to the embodiment, it is possible to arrange the wiring board 170 and the head main body 150 so as to be close in the third direction D3 (Z direction) while securing the space for arranging the guide member 222 and the second driven roller 223 in a state in which the gap between the liquid ejecting face 20*a* and the recording sheet S is set to be small by making the width of the wiring board 170 in the first direction D1 smaller than that of the flow path member 130. Accordingly, it is possible to make the ink jet recording head 1 and the ink jet recording apparatus I small in the third direction D3 (Z direction), and to reduce a cost by making the wiring member 121 short. In addition, since it is possible to make the distance between the first transport unit 210 and the second transport unit 220 small, and to make the gap between the liquid ejecting face 20*a* of the ink jet recording head 1 and the recording sheet S small, without arranging the second transport unit 220 on the outer side of the ink jet recording head 1, that is, on the outer side of a region in which the transport unit and the ink jet recording head face each other in the Z direction, a shift in landing position of ink droplets can be suppressed, and it is possible to perform high-speed printing.

In addition, according to the embodiment, since the second transport roller 221 is provided at a position in which the roller and the flow path member 130 face each other, when the recording sheet S is planarly viewed, that is, when the recording sheet is planarly viewed in the third direction D3 (Z direction) which is the liquid ejecting direction, the second transport roller 221 is arranged at a position at which the roller overlaps with the flow path 1351 of the ink jet recording head 1. That is, as described above, since the flow path forming member 135 which is arranged in the flow path member 130 is a function member in which each function unit such as the filter, the valve, and the heating unit is provided inside thereof, it is necessary to provide a region for arranging each of the function units, or a region for pulling around the flow path 1351 to each of the function units. For this reason, the width of the flow path member 130 in the first direction D1 is formed so as to be large compared to that of the holding member 140. Accordingly, the second transport roller 221 is arranged so as to practically face the flow path 1351 of the flow path member 130 in the third direction D3 (Z direction) each other. As a matter of course, the second transport roller 221 may not be arranged at a position in which the roller and the flow path 1351 face each other in the third direction D3 (Z direction) depending on the arrangement of the flow path 1351.

Other Embodiments

Hitherto, one embodiment of the invention has been described; however, the basic configuration of the invention is not limited to the above described embodiment.

For example, in the above described first embodiment, the connector 173 to which the flexible substrate 400 of the wiring board 170 is connected is provided in the second direction D2 (Y direction) with respect to the first direction D1 which matches the transport direction X, and the flexible substrate 400 is derived in the second direction D2 (Y direction); however, it is not particularly limited to this, and for example, the connector 173 may be provided in the first direction D1, and the flexible substrate 400 may be derived in the transport direction X which matches the first direction D1. However, in order to derive the flexible substrate 400 in the first direction D1, there is a concern that the holding member 140 of the ink jet recording head 1 may become large in the first direction D1, and the distance between the first transport roller 211 and the second transport roller 221 may increase.

In addition, according to the embodiment, the first transport roller 211 of the first transport unit 210 is provided on a face on the recording sheet S on which ink droplets land, that is, on the rear face which is the opposite side to a printing face, and the first driven roller 212 is provided on the printing face; however, it is not particularly limited to this, and the first transport roller 211 may be provided on the printing face, and the first driven roller 212 may be provided on the rear face. In addition, similarly, in the second transport unit 220, the second transport roller 221 may be provided on the printing face, and the second driven roller 223, or the like, may be provided on the rear face side.

In addition, in the above described first embodiment, the first transport roller 211 is provided at a position at which the roller overlaps with the ink jet recording head 1 when planarly viewed in the third direction D3; however it is not limited to this, and at least one of the first transport roller 211 and the second transport roller 221 may be provided at a position at which the roller overlaps with the ink jet recording head 1 when planarly viewed in the third direction D3. That is, only the second transport roller 221 may be provided at the position at which the roller overlaps with the ink jet recording head 1, or both of the first transport roller 211 and the second transport roller 221 may be arranged at a position at which the rollers overlap with the ink jet recording head 1 so as to be inconsistent with each other.

In addition, in the above described first embodiment, as the second transport unit 220, a set of the second transport roller 221 and the second driven roller 223 are provided; however, it is not particularly limited to this, and two or more sets of the second transport roller 221 and the second driven roller 223 may be provided. In this case, it is not necessary to arrange all of the second transport rollers 221 at positions at which the rollers overlap with the ink jet recording head 1, and positions at which the rollers overlap with the wiring board 170, and at least the second transport roller 221 on the first transport unit 210 side may be arranged at a position at which the roller overlaps with the ink jet recording head 1, and does not overlap with the wiring board 170.

In addition, in the above described first embodiment, as a pressure generation unit which causes a pressure change in the pressure generation chamber 12, the piezoelectric actuator 300 in a thin film shape has been used; however, it is not particularly limited to this, and for example, it is possible to use a piezoelectric actuator in a thin film shape which is formed using a method of pasting a green sheet, or the like, a vertical vibration-type piezoelectric actuator in which a piezoelectric material and an electrode forming material are alternately stacked, and are stretched in an axial direction, or the like. In addition, as the pressure generation unit, it is possible to use a unit in which liquid droplets are ejected from a nozzle opening using bubbles which are generated due to heat generation of a heat generating element, by arranging the heat generating element in the pressure generation chamber, a so-called electrostatic actuator in which liquid droplets are discharged from a nozzle opening by generating static electricity between a vibrating plate and an electrode, and by deforming the vibrating plate using a force of the static electricity, or the like.

In addition, in the above described embodiment, as an example of the liquid ejecting apparatus, an ink jet recording apparatus including an ink jet recording head has been described; however, the invention is for overall liquid ejecting apparatuses, and as a matter of course, the invention can be applied to a liquid ejecting apparatus which includes a liquid ejecting head ejecting liquid other than ink. As other liquid ejecting heads, there are, for example, various recording heads which are used in an image recording apparatus such as a printer, a coloring material ejecting head which is used when manufacturing a color filter such as a liquid display, an organic EL display, an electrode material ejecting head which is used when forming an electrode such as a field emission display (FED), a bio-organic material ejecting head which is used when manufacturing a biochip, and the like, and the invention can be applied to a liquid ejecting apparatus which includes the liquid ejecting head.

What is claimed is:

1. A liquid ejecting apparatus comprising:

a first transport roller, and a second transport roller which transports a medium between the first transport roller and the second transport roller; and a liquid ejecting head which includes a plurality of nozzle openings which are arranged between the first transport roller and the second transport roller, and ejects liquid toward the medium which is transported, a pressure generation unit which causes a change in pressure in liquid in a flow path which communicates with the plurality of nozzle openings, a flow path member, and a wiring board of which one face is arranged so as to face a direction in which the liquid is ejected, and is electrically connected to the pressure generation unit, wherein the wiring board is arranged between the first transport roller and the second transport roller, and is arranged at a position at which the wiring board does not overlap with the first transport roller and the second transport roller, and wherein the flow path member extends out from a portion of the liquid ejecting head that includes the plurality of nozzles, the pressure generation unit, and the wiring board to thereby define a space that allows at least one of the first transport roller and the second transport roller to be arranged at a position at which the roller overlaps with the liquid ejecting head, wherein the liquid ejecting head includes a head main body which ejects liquid, and a holding member which holds the head main body, wherein, the wiring board is accommodated inside the holding member, wherein a connector, which is connected to a flexible board, is provided on the wiring board, and the flexible board which is connected to the connecter is positioned in a direction intersecting the transport direction, and wherein the holding member is between the flow path member and the head main body.

2. The liquid ejecting apparatus according to claim 1, wherein at least one of the first transport roller and the second transport roller which is arranged at a position at which the roller overlaps with the liquid ejecting head is arranged at a position overlapping with a flow path which is provided in the liquid ejecting head.

* * * * *